US007954448B2

(12) United States Patent
Yasui et al.

(10) Patent No.: US 7,954,448 B2
(45) Date of Patent: Jun. 7, 2011

(54) FILM FORMING APPARATUS AND METHOD OF FILM FORMATION

(75) Inventors: Motohiro Yasui, Nagoya (JP); Jun Akedo, Tsukuba (JP)

(73) Assignees: Brother Kogyo Kabushiki Kaisha, Nagoya-shi, Aichi-ken (JP); National Institute of Advanced Industrial Science and Technology, Chiyoda-ku, Tokyo (JP)

( * ) Notice: Subject to any disclaimer, the term of this patent is extended or adjusted under 35 U.S.C. 154(b) by 1274 days.

(21) Appl. No.: 11/466,745

(22) Filed: Aug. 23, 2006

(65) Prior Publication Data

US 2007/0046717 A1 Mar. 1, 2007

(30) Foreign Application Priority Data

Aug. 24, 2005 (JP) ..... 2005-243020

(51) Int. Cl.
*B05C 5/02* (2006.01)

(52) U.S. Cl. ..... 118/308; 118/300; 118/50; 427/475

(58) Field of Classification Search ..... 118/301, 118/308, 50; 222/146.3; 239/306; 425/475
See application file for complete search history.

(56) References Cited

U.S. PATENT DOCUMENTS 3,294,324 A * 12/1966 Skaptason ..... 239/288
4,651,672 A * 3/1987 Sommer ..... 118/126
4,679,735 A * 7/1987 Pay ..... 239/708
5,050,801 A * 9/1991 Ferrari ..... 239/211
7,553,376 B2 * 6/2009 Akedo et al. ..... 118/308
2006/0127574 A1 6/2006 Dieckhoff et al.

FOREIGN PATENT DOCUMENTS

JP 09209147 A * 8/1997
JP 2000239825 A * 9/2000
JP 2003293159 A 10/2003
JP 2004265992 A 9/2004
WO 2005014880 A1 2/2005

OTHER PUBLICATIONS

European Patent Office, European Search Report for Related Application No. EP 06017584, dated Dec. 20, 2006.

* cited by examiner

*Primary Examiner* — Parviz Hassanzadeh
*Assistant Examiner* — Charles J Capozzi
(74) *Attorney, Agent, or Firm* — Baker Botts L.L.P.

(57) ABSTRACT

A film forming apparatus includes a film forming chamber for performing a film formation; an exhaust unit connected to the film forming chamber to discharge a gas out of the film forming chamber; a holder provided in the film forming chamber to hold a process-objective material; a jetting nozzle provided in the film forming chamber on which a jetting port is formed in a slit shape, and jetting an aerosol containing particulate material to form a film made of the particulate material on the process-objective material; and a shielding member provided at a side of the jetting port in a longitudinal direction of the jetting port to cover a side of a jet flow of the aerosol jetted from the jetting port. Accordingly, it is possible to suppress a turbulence of a flow of the aerosol due to an exhaust flow, and to form the film uniformly.

8 Claims, 7 Drawing Sheets

FILM FORMING APPARATUS AND METHOD OF FILM FORMATION

CROSS REFERENCE TO RELATED APPLICATION

The present application claims priority from Japanese Patent Application No. 2005-243020, filed on Aug. 24, 2005, the disclosure of which is incorporated herein by reference in its entirety.

BACKGROUND OF THE INVENTION

1. Field of the Invention

The present invention relates to a firm forming apparatus and a method of film formation.

2. Description of the Related Art

As a producing method of a piezoelectric film of a piezoelectric actuator used, for example, in an ink-jet head for an ink-jet printer or the like, a method called as an aerosol deposition method (AD method) is available. The AD method is a method of forming a piezoelectric film by jetting a substance (aerosol), in which fine particles of a piezoelectric material such as Lead Zirconate Titanate (PZT) or the like is dispersed in a gas, toward a surface of a substrate such that the fine particles are collided and deposited onto the substrate. This producing method has been used not only for forming the film of a piezoelectric material, but also for forming a film of a ceramics material and a metallic material.

For example, in Japanese Patent Application Laid-open No. 2003-293159, an apparatus which performs a film formation by using such AD method is disclosed. This apparatus includes an aerosol forming chamber which generates an aerosol, a film forming chamber in which the aerosol generated is jetted onto a substrate, and a jetting nozzle which is provided inside the film forming chamber. When an exhaust pump (air discharge pump) connected to the film forming chamber is operated, the aerosol generated in the aerosol forming chamber is accelerated to a high velocity by a differential pressure between the aerosol chamber and the film forming chamber, and is jetted from the jetting nozzle. Particulate material contained or included in the jetted aerosol are collided and deposited on the substrate, thereby forming a film on the substrate.

In such an apparatus, however, the aerosol jetted from the jetting nozzle flows in a direction of exhaust upon being drawn by an exhaust flow by the exhaust pump in some cases. In such a case, the particulate material is deposited thickly in the direction of exhaust, and a uniform formation of the film is hindered.

SUMMARY OF THE INVENTION

An object of the present invention is to provide a film forming apparatus which performs film formation by the AD method, which is capable of performing a uniform film formation by stabilizing a flow of an aerosol irrespective of a position of an exhaust port.

According to a first aspect of the present invention, there is provided a film forming apparatus including:

a film forming chamber in which a film is formed;

an exhaust unit which is connected to the film forming chamber, and which discharges a gas out of the film forming chamber;

a holder which is provided in the film forming chamber, and which holds a process-objective material (material to be processed);

a jetting nozzle which is provided in the film forming chamber on which a jetting port is formed in a slit shape, and which jets an aerosol containing particulate material from the jetting port toward the process-objective material to form a film made of the particulate material on the process-objective material; and a shielding member which is provided at a side of the jetting port in a longitudinal direction of the jetting port to cover a side of a jet flow of the aerosol jetted from the jetting port toward the process-objective material.

According to a second aspect of the present invention, there is provided a method of film formation including:

preparing an aerosol containing particulate material;

jetting the aerosol from a nozzle, in a film forming chamber; and guiding a jet flow of the aerosol jetted from the nozzle, by a guide member, to a process-objective material held by a holder of the film forming chamber.

In the film forming apparatus and the method of film formation of the present invention, the shielding member or the guide member is capable of suppressing a turbulence of a flow of the aerosol due to an exhaust flow. Accordingly, it is possible to form a film uniformly, regardless of a position of an exhaust port. In particular, since a jet flow of the aerosol tends to flow substantially in a direction along a direction of length (longitudinal direction) of a slit, rather than in a direction along a short direction (width direction) of the slit, it is effective to arrange the shielding member or the guide member so as to shield a gas flow at a side in this longitudinal direction.

In the film forming apparatus and the method of film formation of the present invention, the shielding member and the guide member may include a pair of members facing each other, respectively. In this case, since the aerosol is jetted in an area sandwiched between the pair of members, it is possible to further stabilize the jet flow of the aerosol, and to form the film uniformly.

In the film forming apparatus and the method of film formation of the present invention, the film forming chamber may be provided with an exhaust port to which the exhaust unit is connected; and the shielding member and the guide member may be arranged (installed) in a direction intersecting an exhaust flow of the aerosol heading toward the exhaust port. In this case, since an air flow (gas flow) from the jetting port toward the exhaust port is blocked, it is possible to effectively reduce the turbulence of the jet flow due to the exhaust flow.

In the film forming apparatus and the method of film formation of the present invention, an inner surface, of the shielding member and the guide member, facing the jet flow may be a circular-arc surface which center is away from the jet flow. Further, the method of film formation of the present invention may further include, after guiding the jet flow of the aerosol to the process-objective material, generating a circulating flow by merging the aerosol, bounced off from the process-objective material upon colliding against the process-objective material, with the jet flow of the aerosol along the inner surface of the guide member. In this case, the aerosol which is bounced off from the process-objective material upon colliding against the process-objective material is turned along the circular-arc surface, and is merged with the jet flow of the aerosol from the jetting port toward the process-objective material. Due to such circulation of the aerosol, the particulate material included in the aerosol and bounced off the process-objective material, and hence are not adhered to the process-objective material are reused, thereby improving the efficiency of film formation. Further, at an aerosol merging position, the circulating flow collides against (hits) the jet flow from the side (from side position) and the circulating flow imparts a shearing force to the jet flow. Accordingly, aggregated particulate material is pulverized or crushed to be fine powder (fine particles). Accordingly, it is possible to form a satisfactory film which is thin and uniform.

In the film forming apparatus and the method of film formation of the present invention, the shielding member and the guide member may be installed at a side of an area to which the process-objective material is attached in the holder. In this case, it is easy to secure a space for attaching or setting the process-objective material to the holder, as compared to a case of installing the shielding member and the guide member to the nozzle. Accordingly, it is possible to install the shielding member (the guide member) stably.

In the film forming apparatus and the method of film formation of the present invention, the shielding member and the guide member may be installed at a side of the jetting port of the jetting nozzle. In this case, a size of the shielding member and the guide member may be such that the shielding member and the guide member are capable of covering a width of the jet flow of the aerosol jetted from the jetting port. Accordingly, the shielding member (the guide member) may be of a small size to serve the purpose.

In the film forming apparatus and the method of film formation of the present invention, the shielding member and the guide member may be detachably installed. In this case, when the shielding member or the guide member is dirtied or damaged, maintenance can be performed by removing the shielding member or the guide member from the film forming apparatus. Therefore, it is convenient from a maintenance point of view.

In the film forming apparatus and the method of film formation of the present invention, a hardness of the inner surface of the shielding member and the guide member may be not less than HV 450. Thus, by making the hardness of the inner surface to an extent such that, when the particulate material included in the aerosol is collided against the inner surface, the particulate material of the aerosol is bounced off the inner surface without being embedded in the inner surface, it is possible to prevent the particulate material from adhering to the shielding member or the guide member.

In the film forming apparatus and the method of film formation of the present invention, the shielding member and the guide member may be installed in an openable/closable manner. In this case, it is possible to install and remove the process-objective material with the shielding member or the guide member in an open state, and to form the film with the shielding member or the guide member in a closed state. Therefore, it is convenient.

In the film forming apparatus of the present invention, the exhaust port may be formed in the film forming chamber on a side wall which is on a side of one of the pair of members, with respect to the jetting nozzle. In this case, since it is possible to shield or block, by the shielding member, a space between the exhaust port and the jet flow of the aerosol jetted from the jetting nozzle, thereby effectively reducing the turbulence of the jet flow due to the exhaust flow.

DETAILED DESCRIPTION OF THE PREFERRED EMBODIMENTS

First Embodiment

A first embodiment in which the present invention is embodied will be explained below in detail with reference to FIG. 1 to FIG. 5. In the following explanation, a direction along a jet flow E1 of an aerosol jetted from a jetting nozzle 24 toward a substrate B (up and down direction in the sheet surface of FIG. 1) is made to be a Z-axis direction; a direction along a longitudinal direction of a jetting port 25 in the jetting nozzle 24, among directions orthogonal to the Z axis (left and right direction in the sheet surface of FIG. 5), is made to be an X-axis direction; and a direction along a short direction of the jetting port 25 in the jetting nozzle 24 (up and down direction in the sheet surface of FIG. 5) is made to be a Y-axis direction.

Figure 1:
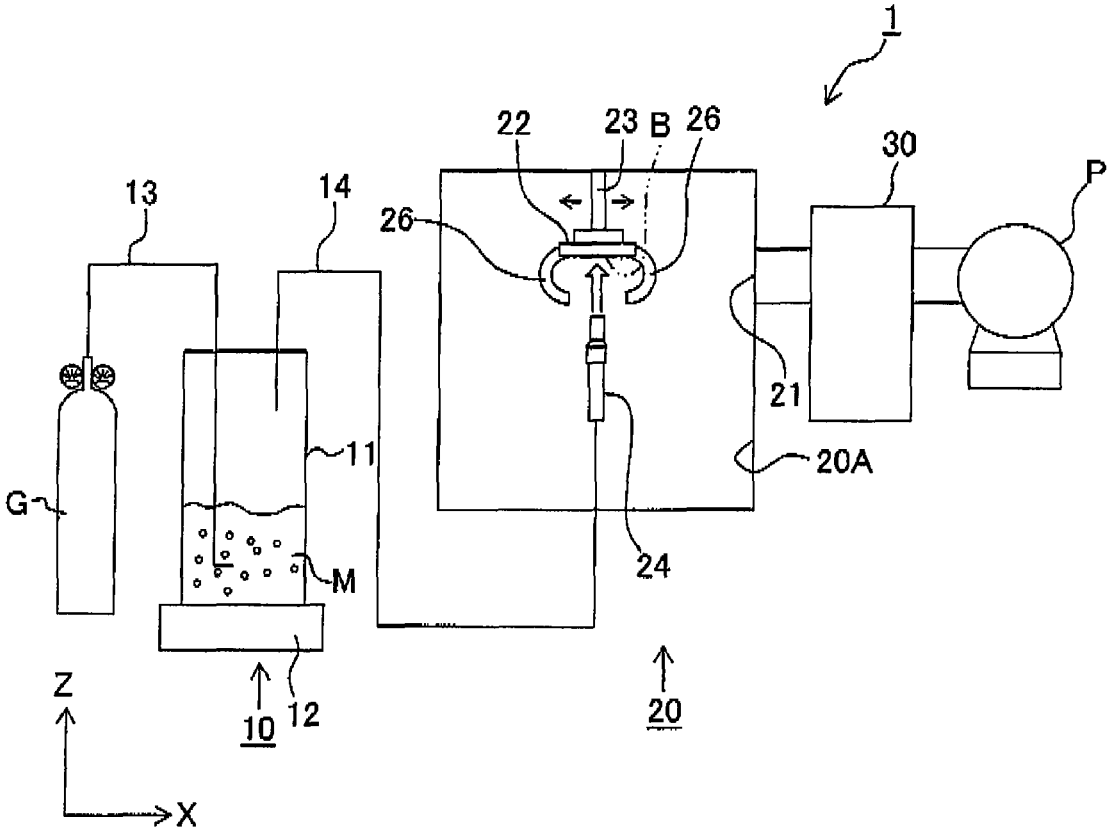
FIG. 1 is a schematic diagram of a film forming apparatus of a first embodiment.

FIG. 1 shows a schematic diagram of a film forming apparatus 1 in which the present invention is embodied. The film forming apparatus 1 includes an aerosol generator 10 which forms an aerosol by dispersing material particles (particulate material) M in a carrier gas, and a film forming chamber 20 in which the aerosol is jetted from the jetting nozzle 24 so as to make the particles in the aerosol to adhere to a substrate.

The aerosol generator 10 includes an aerosol chamber 11 which is capable of accommodating the material particles M therein, and a vibration unit 12 which is attached to the aerosol chamber 11 and which causes the aerosol chamber 11 vibrate. A gas cylinder G for introducing the carrier gas is connected to the aerosol chamber 11 via an introduction pipe 13. An end of the introduction pipe 13 is positioned close to a bottom surface inside the aerosol chamber, and is buried (embedded) in the material particles M. As the carrier gas, for example, inert gas such as helium, argon, and nitrogen, or a gas such as air and oxygen can be used.

The film forming chamber 20 is formed in a shape of a rectangular box, and an exhaust port 21 is opened on a side wall 20A of the film forming chamber 20. A vacuum pump P (exhaust unit) which decompresses the inside of the film forming chamber 20 is connected to the exhaust port 21 via a powder recovery unit 30 which recovers the material particles M from the aerosol after the film formation.

The film forming chamber 20 includes a stage 22 (holder) which supports a substrate B (process-objective material), and the jetting nozzle 24 which is provided below the stage 22.

Figure 5:
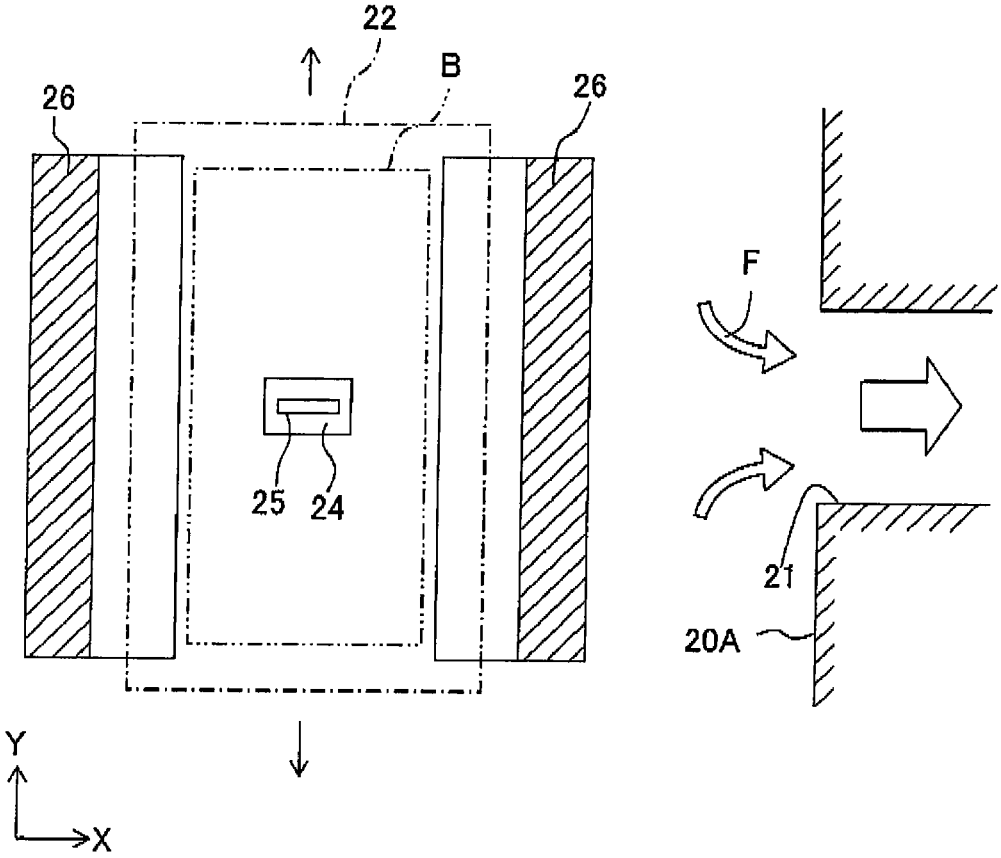
FIG. 5 is a diagram showing the aerosol being jetted from the jetting nozzle onto the substrate, as viewed from a lower surface side, in the first embodiment.

The jetting nozzle 24 is formed to be circular cylinder shaped, which as a whole is extended in the up and down direction (Z-axis direction), and as shown in FIG. 5, an opening portion on an upper side of the jetting nozzle 24 is made to be a slit-shaped jetting port 25. Further, an opening portion on a lower side is connected to the aerosol chamber 11 via an aerosol supply pipe 14, and the aerosol inside the aerosol chamber 11 is supplied to the jetting nozzle 24 through the aerosol supply pipe 14.

Figure 2:
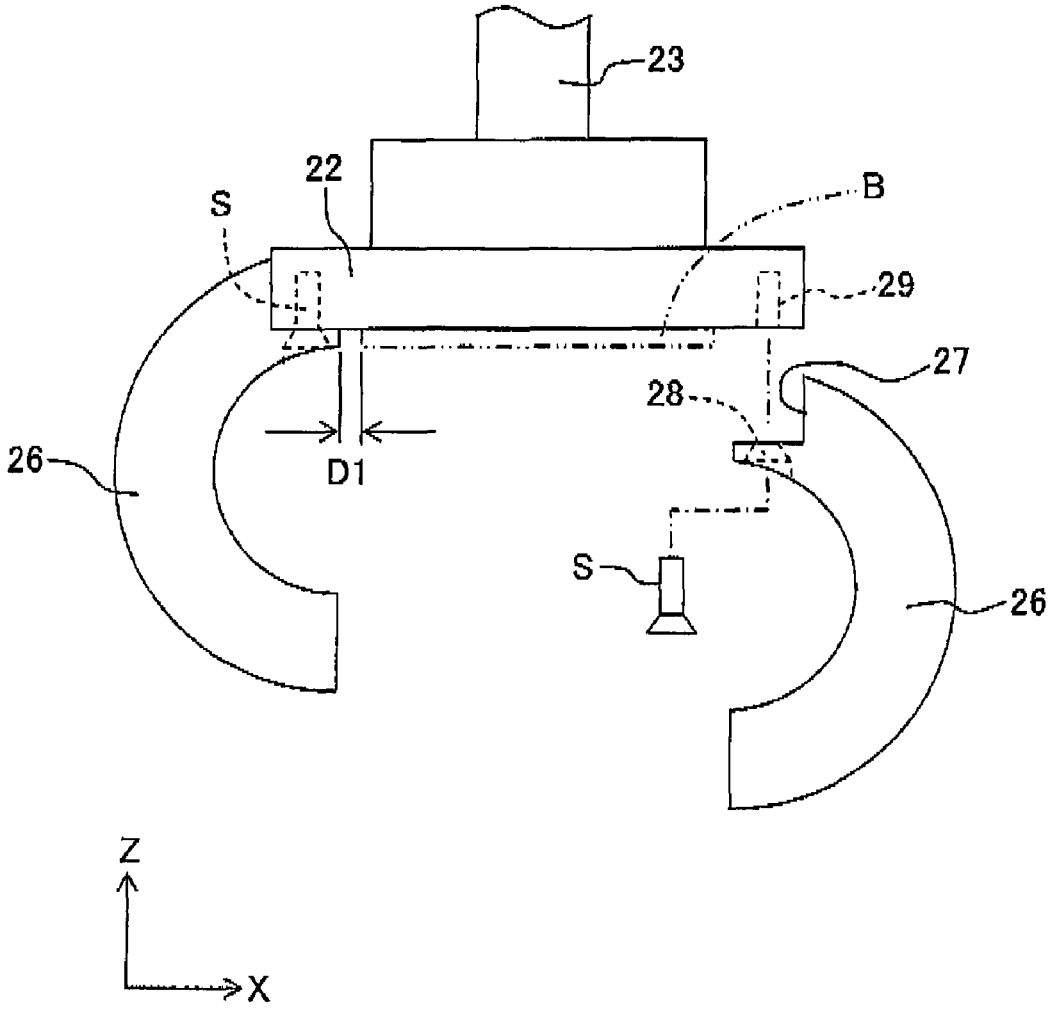
FIG. 2 is a side view of shielding plates and a stage according to the first embodiment.

As shown in FIG. 2, the stage 22 having a shape of a rectangular plate, is suspended from a ceiling in a horizontal posture by a stage moving mechanism 23, such that the stage 22 is capable of holding the substrate B on a side of the lower surface of the stage 22. This stage 22 is formed to be bigger to some extent than the substrate B, and accordingly, portions of the stage 22 sticking out sideway from both edges, respectively, of the substrate B which is attached to the stage 22, are secured as a space for installing a shielding plate 26 which will be explained later, and in this portions, holes 29 opening on the side of the lower surface of the stage 22 are provided.

The stage moving mechanism 23 is a mechanism which is driven according to instructions from a control unit which is not shown in the diagram, and moves this stage 22 in a direction along the longitudinal direction (X-axis direction) and in a direction along the short direction (Y-axis direction) of the jetting port 25 in the jetting nozzle 24, in a plane parallel to a plate surface of the stage 22. Accordingly, the jetting nozzle 24 is movable relative to the substrate B. In other words, when the substrate B is moved linearly in the direction along the short direction (scanning direction) of the jetting port 25 in the jetting nozzle 24, the jetting nozzle 24 scans on a surface of the substrate B, and when the substrate B is moved linearly in the direction along the longitudinal direction of the jetting port 25, a scanning path is changed. In such a manner, by performing a plurality of reciprocating scanning while shifting a relative position of the jetting nozzle 24 little by little with respect to the substrate B, it is possible to jet the aerosol over the entire surface of the substrate B.

Figure 3:
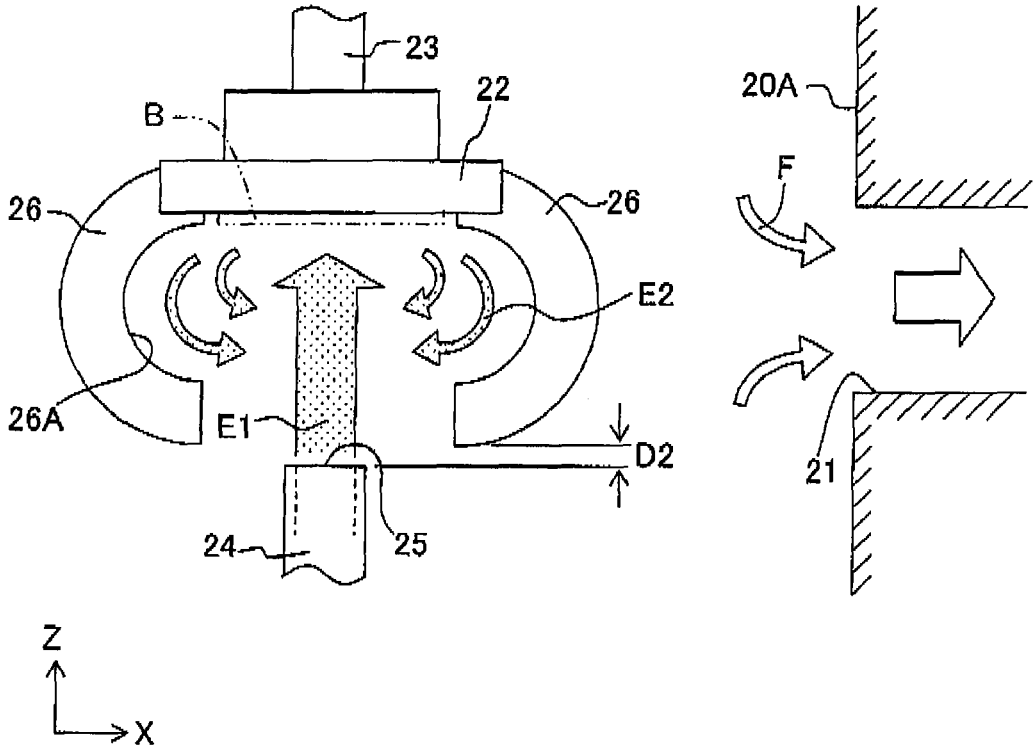
FIG. 3 is a diagram showing an aerosol being jetted from a jetting nozzle onto a substrate, as viewed from a longitudinal side of a jetting port, in the first embodiment.

As shown in FIG. 3, in the stage 22 a pair of shielding plates 26 (shielding member), which shield sides of the jet flow E1 of the aerosol jetted upwardly from the jetting port 25 toward the substrate B, is installed side by side in the direction along the longitudinal direction of the jetting port 25, with the substrate B intervened between the pair. Each of the shielding plates 26 is made of a rectangular shaped stainless steel plate, and is bent to have a circular-arc shape when viewed from a side surface (XZ plane). The two shielding plates 26 are suspended from edge portions of the stage 22, respectively, in a posture such that sides of a concave surface 26A face inward, and that a width direction of the shielding plate 26 (direction intersecting with a circumferential direction of a circular arc) is along the short direction (Y-axis direction) of the jetting port 25 in the jetting nozzle 24. In other words, the pair of shielding plates 26 is arranged such that the circular-arc shaped concave surfaces 26A face mutually while sandwiching or intervening the jet flow E1 of the aerosol therebetween. Further, by forming these concave surfaces 26A to be circular-arc shaped, the concave surfaces 26A are bowed or dent such that a position at each of the concave surfaces 26A, which is a substantially central position in the jetting direction of the jet flow E1, is the farthest from the jet flow E1.

As shown in FIG. 2, an upper end portion of an outer circumference of each of the shielding plates 26 is notched to match with (in accordance with) an angular shape of a corner portion of an edge of the stage 22 in which the shielding plate 26 is to be installed, and a through hole 28 through which a screw S is to be inserted is formed or bored in the up and down direction (Z-axis direction) in a wall portion at a lower side of the notch 27. Further, the notch 27 is put up (matched) with the edge of the stage 22, and the shielding plate 26 is fixed detachably to the stage 22 by inserting the screw S in the through hole 28 and screwing the screw S in the screw hole 29 of the stage 22.

Figure 4:
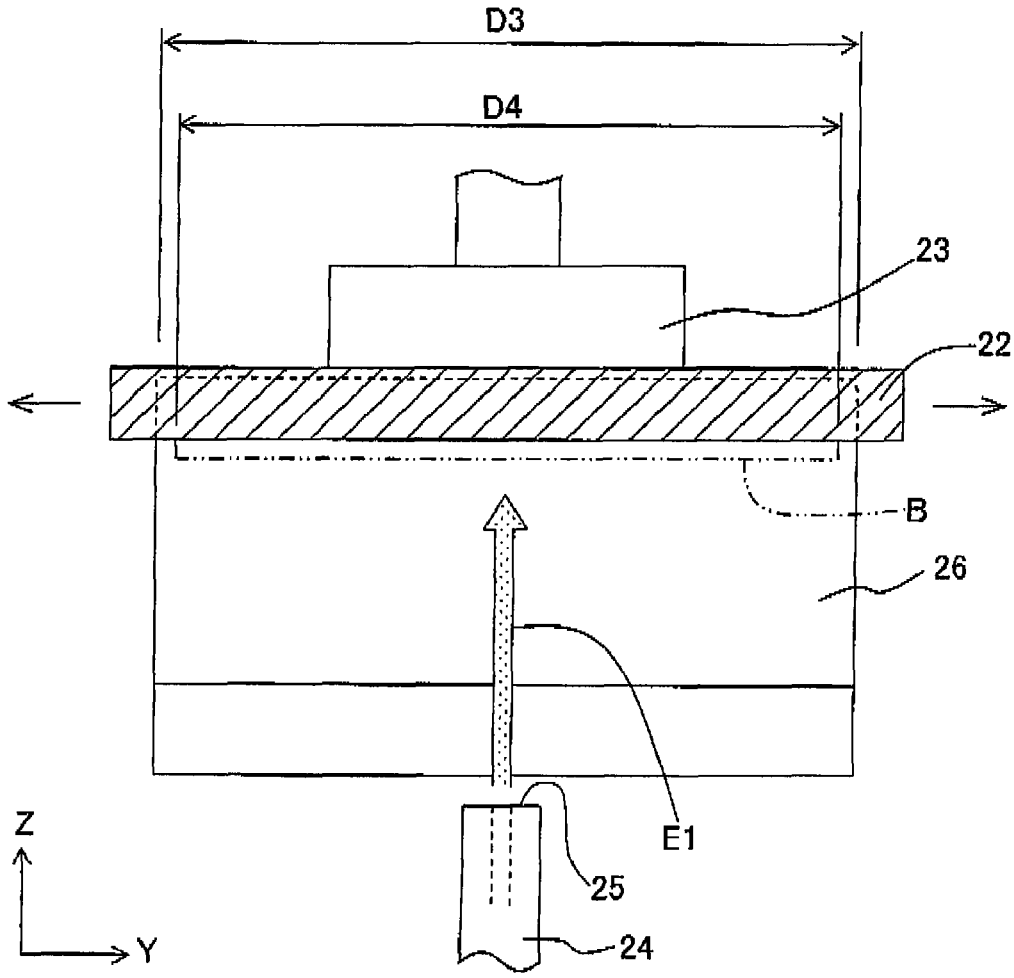
FIG. 4 is a diagram showing the aerosol being jetted from the jetting nozzle onto the substrate, as viewed from a short side (side of width) of the jetting port, in the first embodiment.

It is desirable that a distance D1 between the edge of the substrate B attached to the stage 22 and an inner side edge of the shielding plate 26 shown in FIG. 2 is about not more than 3 mm; a distance D2 in the up and down direction (Z-axis direction) between an upper edge of the jetting nozzle 24 and a lower edge of the shielding plate 26 shown in FIG. 3 is in a range of about ±2 mm; and a width D3 of the shielding plate 26 shown in FIG. 4 is not more than a value of D4+5 mm where D4 is a width of a range of film formation (range over which the material particles M are adhered to the substrate B) by the jetting nozzle 24. A stainless steel plate, having a surface in which Vicker's hardness is not less than HV 450 (450 HV), is used as the stainless steel plate constructing the shielding plate 26, so that the material particles N in the aerosol are hardly adhered to the shielding plate 26.

Further, as shown in FIG. 1, the above-described exhaust port 21 is positioned in the film forming chamber 20, on a side wall 20A on a side same as a side where either one of the shielding plates 26 of the pair is provided, as viewed from the jetting nozzle 24. Accordingly, a space between the exhaust port 21 and the jet flow E1 of the aerosol jetted from the jetting nozzle 24 are shielded by the shielding plate 26.

Next, an explanation will be given about a procedure of forming the film on the substrate B by using the film forming apparatus 1 structured as described above.

At the time of forming a film of the material particles M by using the film forming apparatus 1, firstly, the substrate B is set on the stage 22. Next, the material particles M are charged into the aerosol chamber 11. As the material particles M, for example, lead zirconate titanate (PZT) which is a piezoelectric material can be used.

Further, the carrier gas is introduced from the gas cylinder G so that the material particles M are made to rise up by gas pressure. At the same time, the aerosol chamber 11 is vibrated by the vibration unit 12, thereby mixing the material particles M with the carrier gas to generate the aerosol. Further, the inside of the film forming chamber 20 is decompressed by the vacuum pump P to generate pressure difference between the aerosol chamber 11 and the film forming chamber 20. Due to the pressure difference, the aerosol in the aerosol chamber 11 is ejected from the jetting nozzle 24 while accelerating the aerosol to a high velocity. The material particles M contained in the ejected aerosol are collided on the substrate B and firmly adhere to the substrate B, thereby forming a piezoelectric film. At this time, the film is formed over the entire surface of the substrate B by jetting the aerosol while shifting a relative position of the jetting nozzle 24 little by little with respect to the substrate B by moving the stage 22 by the stage moving mechanism 23. The aerosol, after having been collided against the substrate B, is discharged to a side of the powder recovery unit 30 from the exhaust port 21 by a suction force of the vacuum pump P.

At this time, if the jet flow E1 of the aerosol jetted from the jetting nozzle 24 is flowed, toward the discharge port 21, by being drawn by an exhaust flow F which is generated by the suction force of the vacuum pump P and which heads toward the exhaust port 21, there is a fear that the material particles M are deposited thickly on a side near the exhaust port 21 on the substrate B, and a uniform film formation is hindered as a result. In the first embodiment, however, the shielding plates 26 are installed to the stage 22 and the sides of the jet flow E1 of the aerosol jetted from the jetting port 25 are covered. Accordingly, it is possible to suppress a turbulence of the flow of aerosol due to the influence of the exhaust flow F. In particular, the aerosol tends to flow substantially in the direction along the longitudinal direction of the jetting port 25 (X-axis direction). In the first embodiment, however, the flow of the aerosol is shielded at the side positions in the longitudinal direction, in other words, the shielding plates 26 are arranged (installed) in a posture such that a direction of a plate surface of each of the shielding plates 26 is along the short direction (Y-axis direction) of the jetting port 25. Accordingly, it is possible to effectively suppress the turbulence of the jet flow E1. It is also possible to assume the shielding plate 26 as a guide member which guides the jet flow of the aerosol to the process-objective material.

Furthermore, the exhaust port 21 is positioned in the film forming chamber 20, on the side wall 20A on the side same as the side where one shielding plate 26 of the pair of the shielding plates 26 is provided, as viewed from the jetting nozzle 24. In other words, the shielding plate 26 is arranged (installed) in a direction intersecting the exhaust flow F which is generated in the film forming chamber 20 and is directed toward the exhaust port 21. Accordingly, since a gas flow (air flow) from the jetting nozzle 24 to the exhaust port 21 is shielded by the shielding plate 26, it is possible to effectively reduce the turbulence of the jet flow E1 due to the exhaust flow F.

Further, the pair of shielding plates 26 are arranged to face with each other. Accordingly, since the aerosol is jetted in an area sandwiched between the pair of shielding plates 26, it is possible to further stabilize the jet flow E1, and to form the film uniformly.

Furthermore, as shown in FIG. 3, the shielding plates 26 are curved to be circular-arc shaped as viewed from the side surface thereof, and the inner surface of each of the shielding plates 26 is the circular-arc shaped concave surface 26A. Therefore, a direction of the aerosol bounced off from the substrate B upon colliding against the substrate B is changed to be along this concave surface 26A, and a circulating flow E2 which merges with the jet flow E1 of the aerosol directed from the jetting port 25 to the substrate B is generated. By such a circulation of the aerosol, the material particles M, included in the aerosol bounced off from the substrate B, and thus were not adhered to the substrate B are reused, thereby improving the efficiency of use of the material particles M, as well as the efficiency of the film formation. Moreover, at a merging position, the circulating flow E2 collides against (hits) the jet flow E1 from a side of the jet flow E1, and imparts a shearing force to the jet flow E1. Accordingly, aggregated material particles M included in the jet flow E1 are crushed or pulverized so as to become fine particles (fine powder). Accordingly, it is possible to form a satisfactory film which is thin and uniform.

Thus, according to the first embodiment, the film forming apparatus 1 includes the shielding plates 26 which are provided at sides of the jetting port 25 in the longitudinal direction of the jetting port 25, and which cover the sides of the jet flow E1 of the aerosol jetted from this jetting port 25. Accordingly, since it is possible to suppress the turbulence of the aerosol due to the exhaust flow F, it is possible to form the film uniformly. In particular, since the jet flow E1 tends to flow substantially in the direction along a length direction of the slit (longitudinal direction of the jetting port 25), rather than in a width direction of the slit (short direction of the jetting port 25), the turbulence of the jet flow E1 is suppressed effectively by installing the shielding plates 26 to shield the gas flow at a side in this longitudinal direction. Furthermore, the shielding plates 26 are arranged (installed) in a direction intersecting the exhaust flow F directed from the jetting nozzle 24 toward the exhaust port 21 of the film forming chamber 20. Accordingly, since the gas flow directed from the jetting port 25 toward the exhaust port 21 is blocked, it is possible to effectively suppress the turbulence of the jet flow E1 due to the exhaust flow F.

Further, the pair of shielding plates 26 is provided such that the shielding plates 26 face mutually, sandwiching the jet flow E1 of the aerosol from the jetting nozzle 24 therebetween. Accordingly, since the aerosol is jetted in the area sandwiched between the pair of shielding plates 26, it is possible to further stabilize the jet flow E1, and to form the film uniformly.

Further, the shielding plates 26 are curved to be circular-arc shaped as viewed from the side surface thereof, and the inner surfaces facing the jet flow E1 of the aerosol are made to be the concave surfaces 26A. Accordingly, the aerosol bounced off from the substrate B upon colliding against the substrate B is turned along the concave surfaces 26A, and is merged with the jet flow E1 of the aerosol directed from the jetting port 25 toward the substrate B. By such a circulation of the aerosol, since the material particles M included in the aerosol, which was bounced off the substrate B and thus were not adhered to the substrate B can be reused, the efficiency of film formation is improved. Further, at the aerosol merging position, the circulating flow E2 collides against (hits) the jet flow E1 from the side of to the jet flow E1, and imparts the shearing force to the jet flow E1, thereby crushing the aggregated material particles M to make the material particles M to be fine powder (fine particles). Accordingly, it is possible to form a satisfactory film which is thin and uniform.

Further, the shielding plates 26 are installed to the stage 22. According to such a structure, it is possible to secure the attaching space easily by forming the stage 22 to have a width greater than a width of the substrate B. Accordingly, it is possible to install the shielding plates 26 stably. In addition, the shielding plates 26 are installed detachably. Accordingly, when the shielding plate or plates 26 are dirtied or damaged, the maintenance can be performed by removing the shielding plate or plates 26 from the film forming apparatus 1. Therefore, it is convenient from the maintenance point of view.

Furthermore, the hardness of the stainless steel plate forming the shielding plate 26 is made to be not less than HV 450 (450 HV). Thus, by making the hardness of the shielding plate 26 to an extent such that, when the material particles M included in the aerosol are collided against the shielding plate 26, the material particles M in the aerosol are bounced off from the shielding plate 26 without being embedded in the shielding plate 26, it is possible to prevent the material particles M from adhering and fixing to the shielding plate 26, and to reduce time and/or labor at the time of maintenance.

Second Embodiment

A second embodiment of the present invention will be explained below with reference to FIG. 6 and FIG. 7. The second embodiment differs from the first embodiment mainly in that in the second embodiment, shielding plates 41 are installed on a side of the jetting nozzle 24 rather than on a side of the stage 22. In the second embodiment, similarly as in the first embodiment, the direction along the jet flow E1 of the aerosol jetted from the jetting nozzle 24 toward the substrate B (up and down direction in the sheet surface of FIG. 6) is made to be the Z-axis direction; the direction along a longitudinal direction of the jetting port 25 in the jetting nozzle 24, among directions orthogonal to the Z axis (left and right direction in the sheet surface of FIG. 6), is made to be the X-axis direction; and a direction along the short direction of the jetting port 25 (direction orthogonal to the sheet surface of in FIG. 6) is made to be the Y-axis direction.

The shielding plates 41 in the second embodiment are rectangular shaped stainless steel plates which are curved to be circular-arc shaped as viewed from the side surface thereof (XZ plane). On the other hand, at an upper end position of the jetting nozzle 24, a supporting plate 42 which is projected (extended) toward both sides, respectively, along the longitudinal direction of the jetting port 25 (X-axis direction) is installed. Further, at both of the extended ends of the supporting plate 42, two pieces of the shielding plates 41 are provided in an upright manner in a posture such that concave surfaces 41A of the shielding plates 41 are disposed facing mutually inwardly, and that a width direction of the shielding plates 41 (direction intersecting with a circumferential direction of a circular arc) is along the short direction of the jetting port 25 (Y-axis direction) in the jetting nozzle 24. Accordingly, the shielding plates 41 shield the sides of the jet flow E1 of the aerosol jetted from the jetting port 25.

Figure 6:
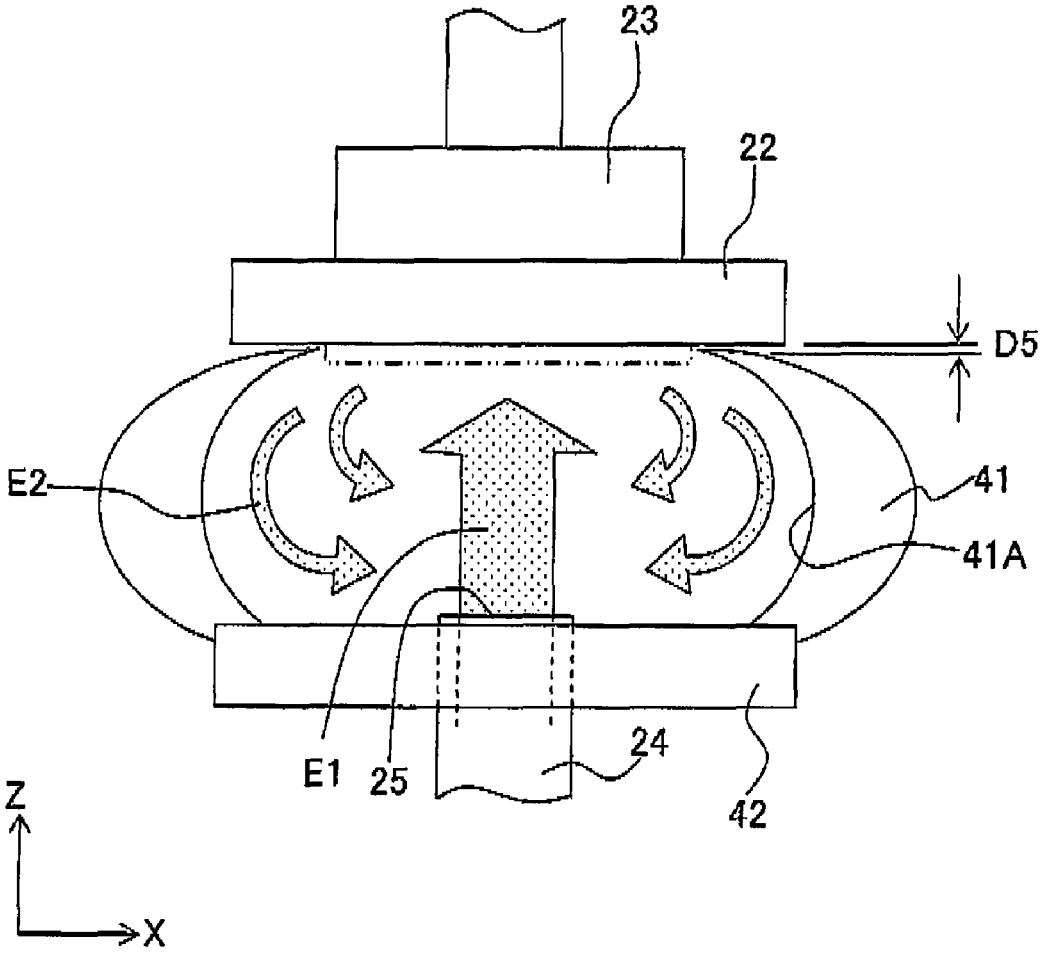
FIG. 6 is a diagram showing the aerosol being jetted from the jetting nozzle onto the substrate, as viewed from a longitudinal side of the jetting port, in a second embodiment.
Figure 7:
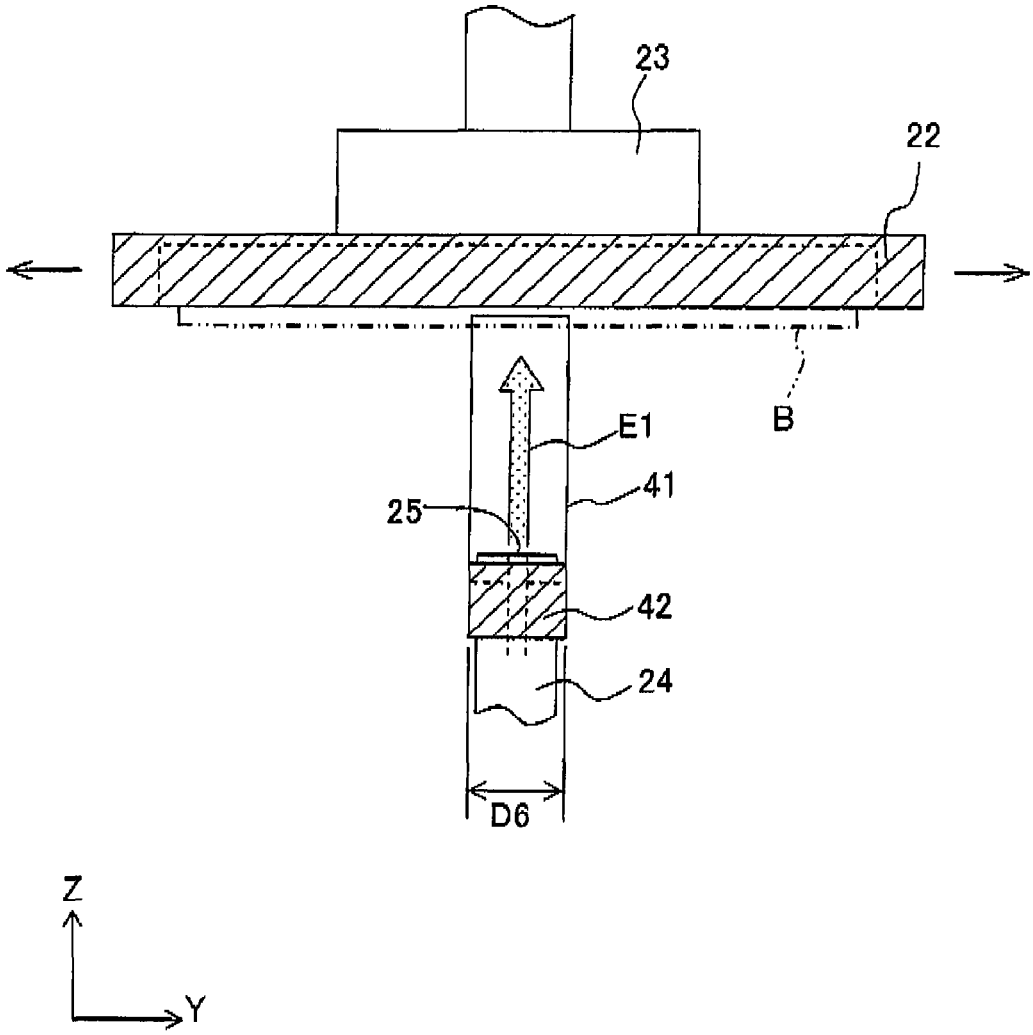
FIG. 7 is a diagram showing the aerosol being jetted from the jetting nozzle on the substrate, as viewed from the short side of the jetting port, in the second embodiment.

It is preferable that a distance D5, between the upper end of the shielding plates 41 and the lower surface of the stage 22 shown in FIG. 6, is not more than 0.5 mm. The thickness of the shielding plates 41 is the maximum at a central position in the up and down direction, and the thickness is progressively diminished toward a side of the upper end side and toward a side of the lower end thereof. Since the shielding plates 41 of the second embodiment are installed to the jetting nozzle 24, and positioned below the stage 22, an upper end position of the concave surface of the shielding plate 41 is made to be as close as possible to the stage 22 to the extent that the shielding plate 41 is not rubbed against the stage 22 or against the substrate B attached to the stage 22, by reducing the thickness of the upper end portion each of the shielding plate 41 in particular. Further, it is preferable that a width DE of the shielding plates 41 as shown in FIG. 7 is not more than a value of a width of an opening of the jetting nozzle 24+5 mm. Since the rest of the structure is similar to the structure in the first embodiment, the same reference numerals are designed to part or component same as those in the first embodiment, and the explanation therefore is omitted.

Thus, also in the second embodiment, since the shielding plates 41 shield the sides of the jet flow E1 of the aerosol jetted from the jetting port 25, a similar effect as in the first embodiment is obtained. In addition, the shielding plates 41 are installed on the side of the jetting nozzle 24. According to such structure, since the width of the shielding plates 41 may be a width sufficient for covering a width of the jet flow E1 of the aerosol jetted from the jetting port 25, the shielding plates 41 may have a small size. Further, since the jetting nozzle 24 is at a center of an area intervened between the shielding plates 41, the circulating flow E2 which is stable all the time is secured regardless of the movement of the stage 22.

Other Embodiment

The scope of the present invention is not intended to be limited to the embodiments as described above. For example, the following configurations are also included into the scope of the present invention. Furthermore, the scope of the present invention also encompasses the range of equivalents.

In the embodiments described above, a pair of the shielding plates 26, 41 are provided facing mutually sandwiching the jet flow E1 of the aerosol from the jetting nozzle 24. However, only one shielding member (shielding plate) may be used.

In the embodiments described above, the shielding plates 26, 41 have a curved shape as viewed from the side surface thereof. However, the shielding plates may have a flat shape, and only the inner surface of the shielding plates 26, 41 may be formed to be a concave surface.

In the embodiments described above, the stainless steel plates are used as the shielding plates 26, 41. However, the shielding plates 26, 41 may be plates, for example, in which a surface of the plates formed of a resin or the like is coated by a metallic material having a high surface hardness.

In the embodiments described above, the shielding plates 26 are installed detachably. However, the shielding plates (shielding member) may be fixed and thus made to be undetachable.

In the embodiments described above, the shielding plates 26 and 41 are installed to the stage 22 or to the supporting plate 42 of the jetting nozzle 24. However, the position at which the shielding plate is to be installed is not limited to the stage 22 and the supporting plate 42 of the nozzle 24, and the shielding plates may be installed, for example, to an upper wall of the film forming chamber, provided that it is possible to suppress the turbulence of the jet flow of the aerosol by the exhaust flow.

Further, in the film forming apparatus and the method of film formation of the present invention, the shielding plates 26, 41 may be installed openably/closably. In this case, since it is possible to attach and remove the substrate B in a state that the shielding plates 26, 41 are open; and it is possible to form the film in a state that the shielding plates 26, 41 are closed, which is convenient.

What is claimed is:

1. A film forming apparatus comprising:

a film forming chamber in which a film is formed;

an exhaust unit which is connected to the film forming chamber, and which discharges a gas out of the film forming chamber;

a holder which is provided in the film forming chamber, and which holds a process-objective material;

a jetting nozzle which is provided in the film forming chamber, on which a jetting port is formed in a slit shape, and which jets an aerosol containing particulate material from the jetting port toward the process-objective material to form a film made of the particulate material on the process-objective material; and a shielding member which is provided at a side of the jetting port in a longitudinal direction extending along a direction from the jetting port toward the process-objective material to cover a side of a jet flow of the aerosol jetted from the jetting port toward the process-objective material, wherein the film forming chamber comprises an exhaust port to which the exhaust unit is connected, and the shielding member is disposed to intersect an exhaust flow of the aerosol toward the exhaust port and wherein an inner surface of the shielding member, which faces the jet flow, is a circular-arc surface, a center of which is farthest away perpendicular to the jet flow.

2. The film forming apparatus according to claim 1, wherein the shielding member includes a pair of members facing each other.

3. The film forming apparatus according to claim 1, wherein the shielding member is installed at a side of an area to which the process-objective material is attached in the holder.

4. The film forming apparatus according to claim 1, wherein the shielding member is installed at a side of the jetting port of the jetting nozzle.

5. The film forming apparatus according to claim 1, wherein the shielding member is detachably installed.

6. The film forming apparatus according to claim 1, wherein a hardness of the inner surface of the shielding member is not less than HV 450.

7. The film forming apparatus according to claim 1, wherein the shielding member is installed in an openable/closable manner.

8. The film forming apparatus according to claim 1, wherein the exhaust port is formed in the film forming chamber on a side wall which is on a side of one of the pair of members, with respect to the jetting nozzle.

* * * * *